US008002156B2

(12) United States Patent
Ota

(10) Patent No.: US 8,002,156 B2
(45) Date of Patent: Aug. 23, 2011

(54) HANDICRAFT CLIP

(75) Inventor: Hiroko Ota, Osaka (JP)

(73) Assignee: Clover Mfg. Co., Ltd., Osaka (JP)

( * ) Notice: Subject to any disclaimer, the term of this patent is extended or adjusted under 35 U.S.C. 154(b) by 397 days.

(21) Appl. No.: 12/221,590

(22) Filed: Aug. 5, 2008

(65) Prior Publication Data

US 2009/0038522 A1 Feb. 12, 2009

(30) Foreign Application Priority Data

Aug. 8, 2007 (JP) ..... 2007-206453

(51) Int. Cl.
*D06J 1/12* (2006.01)
*A41H 43/00* (2006.01)

(52) U.S. Cl. ..... 223/35; 112/144

(58) Field of Classification Search ..... 223/28–38; 112/144–146; 38/102.91
See application file for complete search history.

(56) References Cited

U.S. PATENT DOCUMENTS 703,110 A * 6/1902 Beiermeister ..... 223/37
1,166,174 A * 12/1915 Besbee ..... 223/35
1,852,604 A * 4/1932 Canfield ..... 223/71
2,595,790 A * 5/1952 Holcomb ..... 223/30
2,711,847 A * 6/1955 Kessler ..... 223/30
2,834,522 A * 5/1958 Ogle ..... 223/34
2,855,649 A * 10/1958 Kanter ..... 223/87
3,889,858 A * 6/1975 Hack ..... 223/35
4,012,811 A * 3/1977 Mazzaferro ..... 24/487
5,441,509 A * 8/1995 Vidal et al. ..... 606/151
5,899,160 A 5/1999 Hoag

* cited by examiner

*Primary Examiner* — Ismael Izaguirre
(74) *Attorney, Agent, or Firm* — Hamre, Schumann, Mueller & Larson, P.C.

(57) ABSTRACT

A handicraft clip is provided for forming a pleat in a cloth. The clip includes a relatively wide base plate and a narrower fastening plate connected to the base plate via a connecting hinge portion having a reduced thickness for allowing pivotal movement of the fastening plate relative to the base plate. The base plate is formed with a generally elliptical through-hole, while the fastening plate is provided with a locking protrusion to be fitted into the through-hole of the base plate when the base plate and the fastening plate are superposed on each other. The fastening plate includes a cloth holding portion of a generally constant width. The cloth holding portion is formed with a slit for insertion of a cloth. The slit extends from the distal end of the cloth holding portion toward the locking protrusion.

9 Claims, 5 Drawing Sheets

HANDICRAFT CLIP

BACKGROUND OF THE INVENTION

1. Field of the Invention

The present invention relates to a handicraft clip suitably used for handicraft work such as patchwork.

2. Description of the Related Art

In the field of handicraft works such as patchwork, a technique so called "puff quilt" is known as one of the methods that provide excellent ornamental effects. For example, U.S. Pat. No. 5,899,160 discloses a conventional puff quilt square maker and a method for fabricating a puff quilt square. Generally, the puff quilt is performed with a plurality of square-shaped quilting materials (puffs). The puff is made through superposing a pleated cloth over a base cloth and sewing these cloths together, which allows forming various design patterns depending on the pleating form, and also stuffing padding in between the cloths, to thereby form a three-dimensionally swollen shape. To practically form the puff, for example, two pieces of square cloths that are different in size are prepared. Each of the four sides of the larger cloth is pleated so as to make the size thereof the same with the smaller cloth, and the pleats are temporarily fixed with marking pins. Then the two cloths are laid on each other and a sewing margin is defined so as to sew the perimeter of the stacked cloths. In the case where the puff is to be stuffed with padding, for example a portion of the perimeter is left open for inserting the padding therethrough, instead of sewing the entire perimeter, and then the cloths are turned inside out through the opening, after which the padding is stuffed and the opening is sewn to close. The puff thus made up obtains a shape swelling toward the upper side, as shown in FIG. 11. The puff quilt is made up by combining a plurality of such puffs and sewing the edges together, or sewing the puffs onto another base cloth.

When performing the patchwork with the puff quilt, a large number of puffs are often employed according to the design. In this case, it is so difficult to make pleats of the same size and same form on all of the large number of puffs.

SUMMARY OF THE INVENTION

The present invention has been proposed in the foregoing circumstances. It is therefore an object of the present invention to provide a handicraft clip that facilitates, when making a pleated quilt material such as a puff, efficient forming of pleats in generally the same size.

According to the present invention, there is provided a handicraft clip for forming a pleat in a cloth. The clip comprises: a base plate including a first portion and a second portion of a predetermined width, the first portion having a basal end portion, the second portion being integral with the first portion and having a distal end portion; and a fastening plate including a first portion and a second portion, the first portion of the fastening plate having a basal end portion, the second portion of the fastening plate being integral with the first portion of the fastening plate and having a distal end portion, the fastening plate being pivotally connected, at the basal end portion thereof, to the basal end portion of the base plate. The base plate and the fastening plate are foldable to face each other in a manner such that the first portions of the respective plates are superposed on each other, and that the second portions of the respective plates are superposed on each other. The second portion of the fastening plate is formed with a slit extending from the distal end portion of the fastening plate toward the basal end portion of the fastening plate.

Preferably, the slit formed in the fastening plate may be located at a widthwise center of the second portion of the base plate when base plate and the fastening plate are superposed on each other.

Preferably, the second portion of the base plate may be formed with a slit extending from the distal end portion of the base plate toward the basal end portion of the base plate.

Preferably, the slit formed in the base plate may be located at a widthwise center of the second portion of the base plate.

Preferably, the handicraft clip of the present invention may further comprise a lock for keeping the base plate and the fastening plate superposed on each other.

Preferably, the lock may include a through-hole and a protrusion to be fitted into the through-hole. The through-hole may be formed in one of the first portions of the respective plates, while the protrusion on the other of the first portions of the respective plates.

Preferably, the protrusion may be fitted in the through-hole in a manner such that an end portion of the protrusion sticks out beyond an end portion of the through-hole.

Preferably, the second portions of the respective plates may have cloth holding surfaces brought into facing relation when these second portions are superposed on each other, where each of the cloth holding surfaces is formed with an elongated projection extending widthwise of the second portions.

Other features and advantages of the present invention will become more apparent through the following detailed description given with reference to the accompanying drawings.

DETAILED DESCRIPTION OF THE PREFERRED EMBODIMENTS

Preferred embodiments of the present invention will be described with reference to the accompanying drawings.

Figure 1:
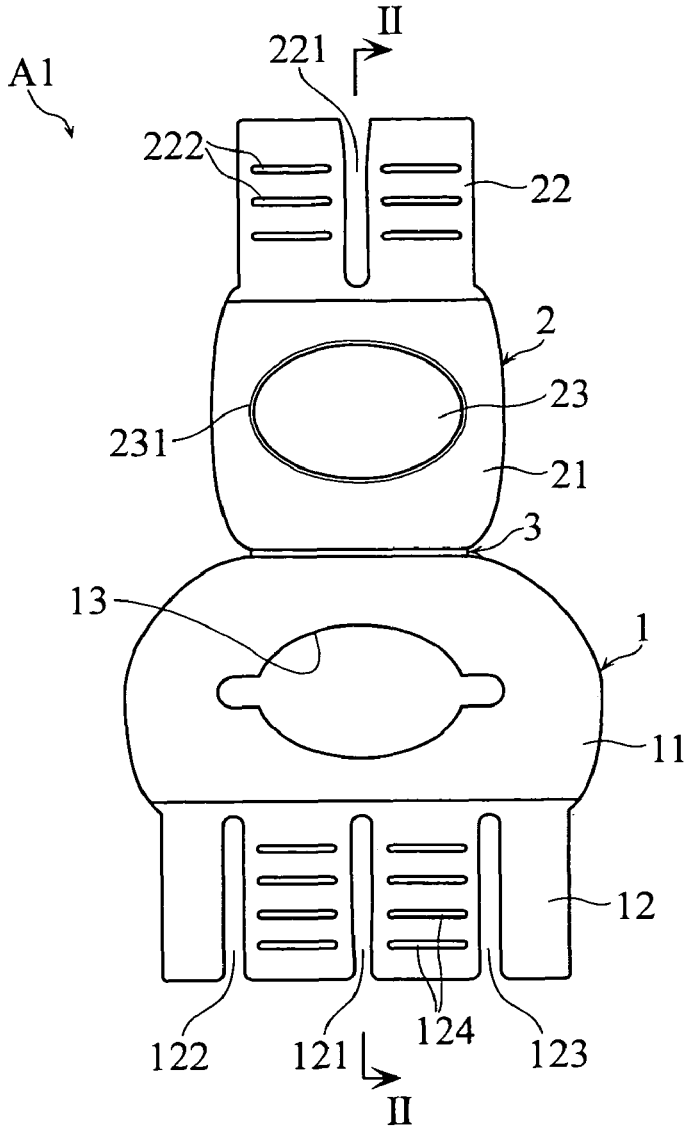
FIG. 1 is a plan view showing a handicraft clip according to the present invention.
Figure 2:
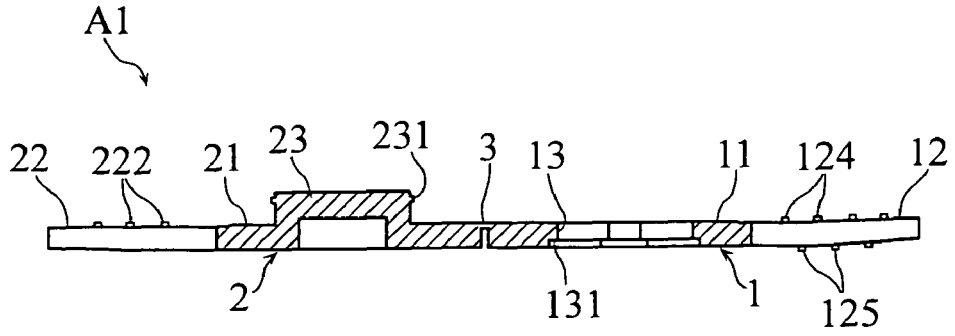
FIG. 2 is a sectional view taken along a line II-II in FIG. 1.

FIG. 1 is a plan view showing a handicraft clip according to the present invention. FIG. 2 is a cross-sectional view taken along a line II-II in FIG. 1. As shown in FIG. 1, the handicraft clip A1 according to this embodiment, including a base plate 1, a fastening plate 2, and a lock or locking means L (see FIG. 4), is integrally formed as a single unit made of a synthetic resin (such as polypropylene) having an appropriate strength. The handicraft clip A1 serves to form a pleat on the perimeter of a cloth, when making a quilt material such as a puff.

The base plate 1 includes a thin base portion 11 of a predetermined thickness, and a clip element 12 extending from the base portion 11. The base portion 11 is of a shape stretched widthwise thereof (left and right direction in FIG. 1), so as to enable the user to easily hold the portion in his or her hand. The base portion 11 is formed with a generally elliptical through-hole 13, located in a central region and penetrating throughout the thickness of the base portion. As is apparent from FIG. 2, the inner wall of the through-hole 13 includes an engaging stepped portion 131 formed at a lower portion thereof, along the entire inner circumferential surface of the through-hole.

The clip element 12 extends from an edge portion of the base portion 11 toward a distal end, and has a predetermined width and length. The clip element 12 is formed with three slits 121 to 123 of a predetermined width, extending from the distal end portion toward the base portion 11. In this embodiment, the slit 121 is located at the widthwise center of the clip element 12, and the slits 122, 123 are spaced from the central slit 121 by the same distance. Also as shown in FIGS. 1 and 2, the clip element 12 is formed with a plurality of elongated projections 124, 125 extending widthwise on the upper and lower surfaces of the element 12, provided for preventing slippage of the cloth.

Figure 3:
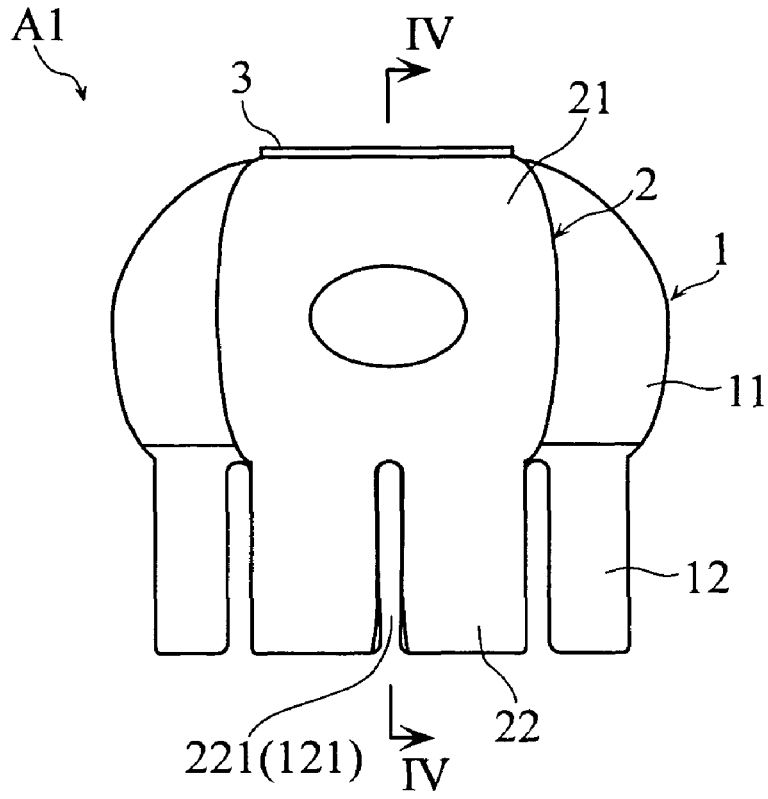
FIG. 3 is a plan view showing the handicraft clip of FIG. 1, with the fastening plate superposed over the base plate.
Figure 4:
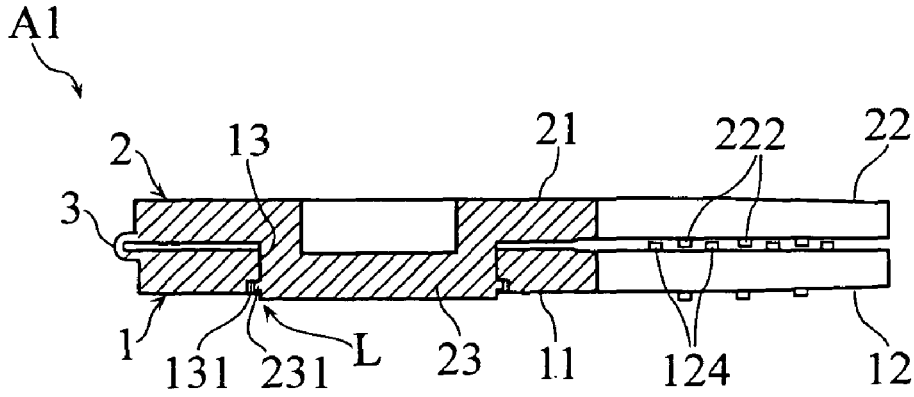
FIG. 4 is a sectional view taken along a line IV-IV in FIG. 3.

The fastening plate 2 includes a main plate 21 and a clip element 22 extending from the main plate 21. The main plate 21 is generally the same in thickness as the base portion 11 of the base plate 1, and connected to the basal end portion of the base portion 11 via a joint portion 3 having a reduced thickness and extending in the widthwise direction along the basal end portion. Such configuration permits the fastening plate 2 to pivot about the joint portion 3 toward or away from the base plate 1. The main plate 21 includes a generally elliptical protrusion 23 formed substantially in a central region thereof. The protrusion 23 is made slightly smaller than the through-hole 13 of the base plate 1 in a plan view, so as to be fitted into the through-hole 13 when the fastening plate 2 is folded onto the base plate 1. Thus, as shown in FIGS. 3 and 4, the fastening plate 2 can be folded upon the base plate 1 such that the main plate 21 and the base portion 11, as well as the clip element 22 and the clip element 12, are respectively superposed over each other. The height of the protrusion 23 is made greater than the thickness of the base portion 11. Accordingly, when the protrusion 23 is fitted into the through-hole 13, the end portion of the protrusion 23 sticks out beyond the lower end portion of the through-hole 13. The protrusion 23 includes an engaging stepped portion 231 projecting from the upper end portion thereof, along the entire outer circumferential surface thereof.

The clip element 22 extends from an end portion of the main plate 21 toward a distal end portion, and has a predetermined width and length. The clip element 22 is made smaller in width than the clip element 12 of the base plate 1, and substantially the same in length as the clip element 12. The clip element 22 includes a slit 221 of a predetermined width extending from the distal end portion thereof toward the main plate 21. The slit 221 is located at the widthwise center of the clip element 22. Here, the widthwise center of the clip element 22 coincides with the widthwise center of the clip element 12. Thus, as shown in FIG. 3, once the clip element 22 is superposed over the clip element 12, the slit 221 of the clip element 22 is located at the center of the clip element 12, and communicates with the slit 121. Also as shown in FIG. 1, the clip element 22 includes a plurality of elongated projections 222 extending widthwise on the upper surface thereof, provided for preventing slippage of the cloth.

The lock L serves to keep the fastening plate 2 superposed over the base plate 1, and includes the engaging stepped portion 131 formed along the inner circumferential surface of the through-hole 13 of the base plate 1, and the engaging stepped portion 231 formed along the outer circumferential surface of the protrusion 23 of the fastening plate 2, which constitute the operative portion of the lock L. When the fastening plate 2 is superposed over the base plate 1, the protrusion 23 is introduced into the through-hole 13. Upon pressing the fastening plate 2 against the base plate 1 with a predetermined or a greater force, the engaging stepped portion 231 is elastically deformed slightly so as to pass through the inner circumferential surface of the through-hole 13, to be thereby engaged with the engaging stepped portion 131. Such action causes the main plate 21 of the fastening plate 2 to be completely superposed over the base portion 11 of the base plate 1, such that the fastening plate 2 is inhibited from moving away from the base plate 1.

Now, a method of making up a puff with the handicraft clip A1 thus configured will be described referring to FIGS. 5 to 10. The following refers to the case of making a basic puff utilizing four pieces of handicraft clips A1.

To start with, two pieces of square cloths of different sizes are cut out, to form the puff. The larger cloth (hereinafter, top cloth C1) is used to form pleats, to be finally located on the upper face of the puff. The small cloth (hereinafter, base cloth C2) is to be superposed over the top cloth C1 with the pleats formed, to be thereby sewn together.

When cutting out the top cloth C1 and the base cloth C2, employing a template (not shown) facilitates efficiently performing the job. The template may be two square frames of the same dimensions as the top cloth C1 base cloth C2 respectively. In this case, putting markings on the back of the cloth along the perimeter of the respective templates, and cutting the cloth along the markings leads to preparation of the top cloths C1 and the base cloths C2 in uniform dimensions. Regarding the template for the base cloth C2, it is convenient to provide a stitch line along the inner perimeter of the frame.

Figure 5:
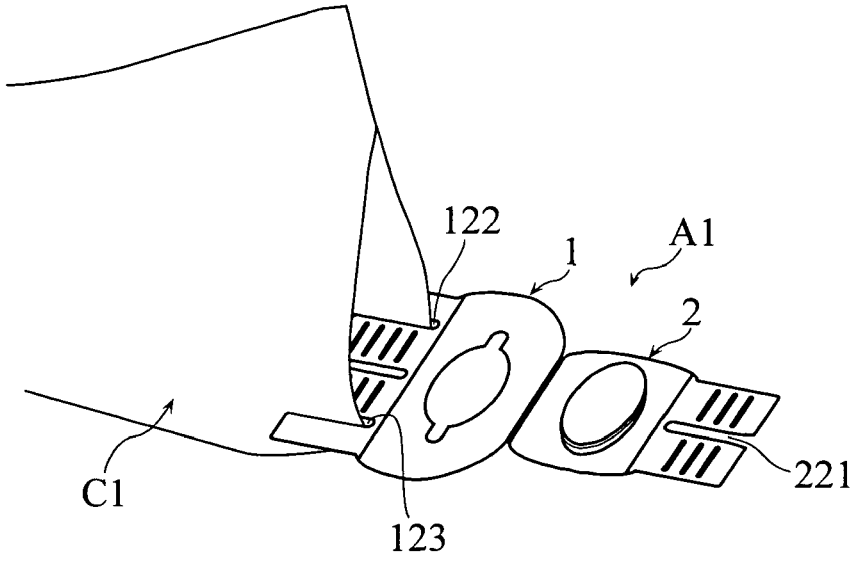
FIG. 5 is a perspective view for explaining a procedure in using the handicraft clip shown in FIG. 1.
Figure 6:
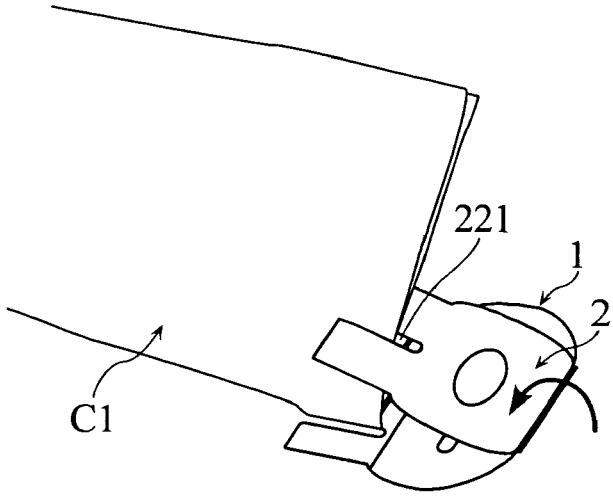
FIG. 6 is a perspective view for explaining the procedure in using the handicraft clip shown in FIG. 1.
Figure 7:
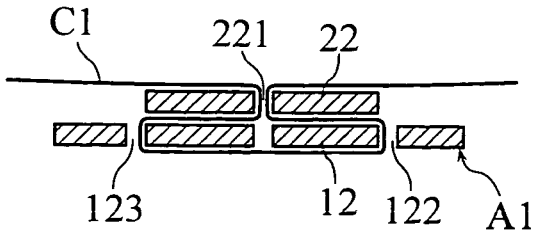
FIG. 7 is a schematic view showing in section the handicraft clip shown in FIG. 1 forming a pleat on a cloth.
Figure 8A:
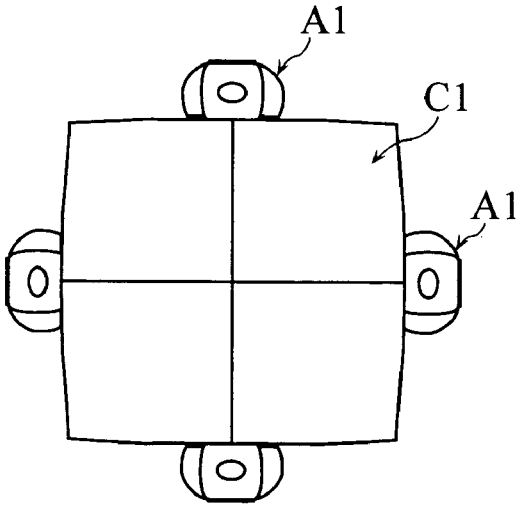
FIG. 8A is a front-side, schematic view for illustrating the procedure of use of the handicraft clip shown in FIG. 1.
Figure 8B:
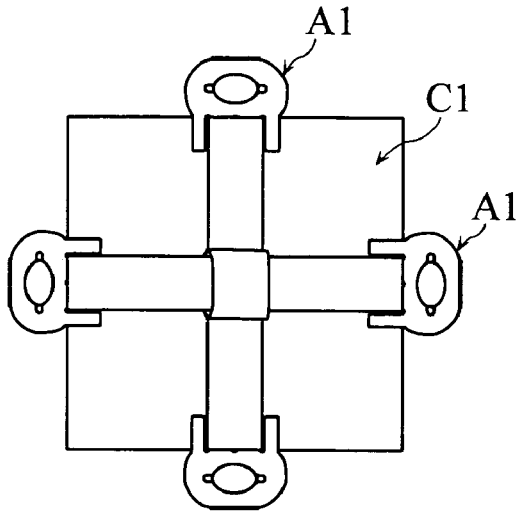
FIG. 8B is a back-side, schematic view for illustrating the procedure of use of the handicraft clip shown in FIG. 1.

The handicraft clip A1 is now employed to form the pleats. The top cloth C1 is folded in half face to face, and the edge portion of the cloth on the respective sides of the folded point is inserted into the left and right slit 122, 123 of the base plate 1 as shown in FIG. 5, and the end portions of the folded cloth are put together and lifted upward. Then as shown in FIG. 6, the fastening plate 2 is lifted and folded onto the base plate 1. At this step, the edge portion of the top cloth C1 now folded in double is introduced into the slit 221 of the fastening plate 2. Upon pressing the back of the protrusion 23 on the fastening plate 2 against the base plate 1, the engaging stepped portion 231 of the protrusion 23 is engaged with the engaging stepped portion 131 of the through-hole 13, thereby actuating the lock L. At this stage, a pleat is formed on the top cloth C1 by the handicraft clip A1, as shown in FIG. 7. Another handicraft clip A1 is then applied to the opposite side of the top cloth C1 in the same way, to thereby form the pleat. Then to the remaining two sides of the top cloth C1 also, the handicraft clip A1 is likewise attached. FIGS. 8A and 8B are schematic plan views showing the top cloth C1 to which the four pieces of handicraft clips A1 are attached, and FIG. 8A shows the front side and 8B the back side.

Figure 9:
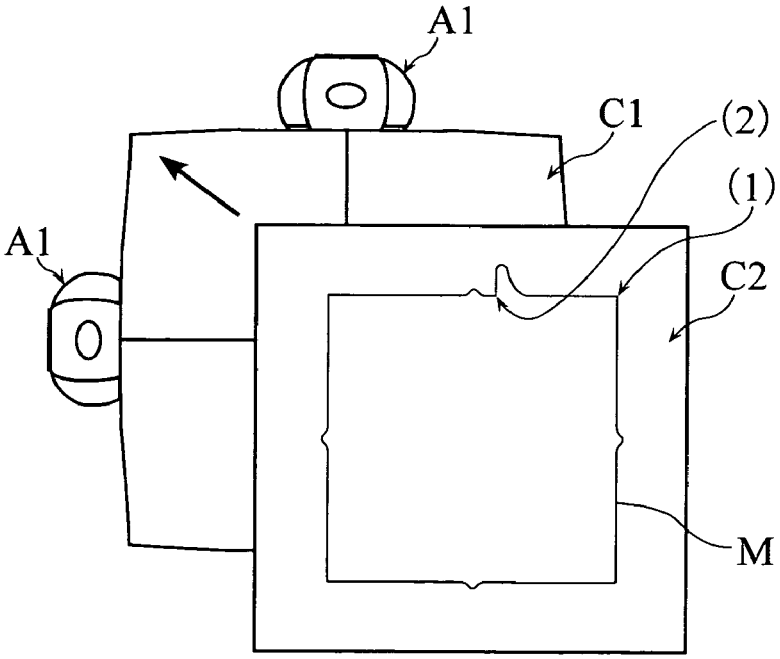
FIG. 9 is a plan view for explaining a procedure of use of the handicraft clip shown in FIG. 1.
Figure 10:
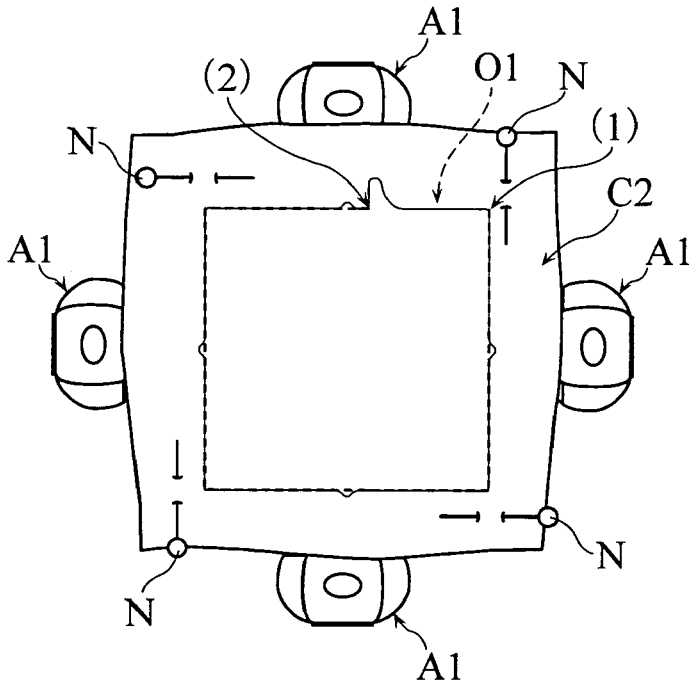
FIG. 10 is a plan view for explaining a procedure of use of the handicraft clip shown in FIG. 1.

Then the top cloth C1 and the base cloth C2 are sewn together. As shown in FIG. 9, the top cloth C1 and the base cloth C2 are stacked face to face, and the sewing margin is fixed with a marking pin N as shown in FIG. 10. On the base cloth C2, for example a stitch line M is marked, so that the base cloth C2 and the top cloth C1 are sewn together along the stitch line M over a predetermined region. In this embodiment, a position designated by (1) in FIG. 10 is the starting point of the stitch, and (2) designates the finishing point. The region between the starting point (1) and the finishing point (2) is an unsewn region (opening O1). Regarding the stitch method, for example a back stitch may be employed at the starting point and the finishing point, and a running stitch may be employed in the remaining portion. The sewing may be performed either with a sewing machine or by hand. Upon completing the sewing process, the four handicraft clips A1 are removed and a surplus portion of the sewing margin is cut off.

Figure 11:
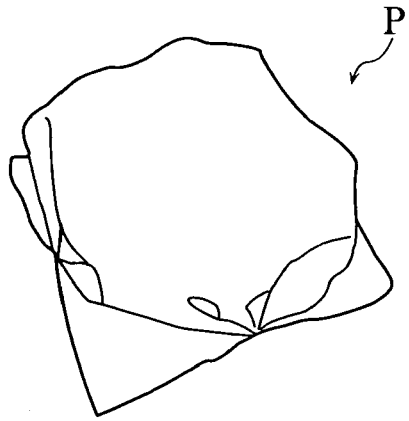
FIG. 11 is a perspective view showing a quilt material made up by the handicraft clip shown in FIG. 1.

Then the cloths sewn together is turned inside out through the opening O1, and padding is introduced therethrough. Finally, the opening O1 is sewn to close. That is how a padded puff P as shown in FIG. 11 can be obtained.

As may be understood from FIG. 7, when forming a pleat with the handicraft clip A1 according two this embodiment, the clip element 12 of the base plate 1 serves to determine a first folding position, and the slit 221 of the fastening plate 2 serves to determine a second folding position. Thus, the handicraft clip A1 permits sequentially and efficiently forming pleats of substantially the same size. Also, the slits 122, 123 on the left and right side of the base plate facilitate forming the first folding position.

The handicraft clip A1 also includes the lock L. This device serves to maintain the pleated portion of the top cloth C1 in the state of being held between the clip elements 11, 12. Accordingly, the handicraft clip A1 can be prevented from accidentally coming off from the top cloth C1.

Further, in the handicraft clip A1, simply superposing the fastening plate 2 over the base plate 1 causes the engaging stepped portions 131, 231 to be mutually engaged, thereby actuating the lock L. Such arrangement enhances the usefulness of the handicraft clip A1.

In the handicraft clip A1, the clip elements 11, 12 each include a plurality of projections 124, 125, 222. These projections serve to restrict a relative positional shift between the clip element 11, 12 and the top cloth C1 held therebetween.

In the handicraft clip A1, to use the lock L, the protrusion 23 is inserted into the through-hole 13 until the end portion of the protrusion 23 protrudes beyond the end of the through-hole 13. Thereafter, the user can easily release the lock L simply by pushing the button-shaped end portion of the protrusion 23 back into the through-hole 13 with the thumb, for example.

Figure 12:
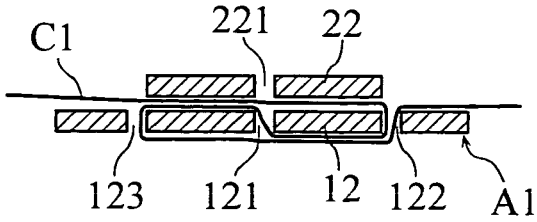
FIG. 12 is a schematic cross-sectional view showing the handicraft clip shown in FIG. 1 forming a pleat on a cloth in another manner.

The base plate 1 of the handicraft clip A1 includes the plurality of slits 121 to 123. Such configuration allows forming pleats of a plurality of different types according to how the top cloth C1 is inserted through the slits 121 to 123. FIG. 12 illustrates a different pleating pattern of the top cloth C1 formed around the clip elements 12, 22, so as to make a puff of a different design from that of the foregoing basic shape. In this case, a pleat folded back in an S-shape is formed, which provides a puff of a different design from that of the basic shape.

The present invention being thus described, it is obvious that the same may be varied in many ways. Such variations are not to be regarded as a departure from the spirit and scope of the present invention, and all such modifications as would be obvious to those skilled in the art are intended to be included within the scope of the following claims.

The invention claimed is:

1. A handicraft clip for forming a pleat in a cloth, the clip comprising:

a base plate including a first portion and a second portion of a predetermined width, the first portion having a basal end portion, the second portion being integral with the first portion and having a distal end portion;

a fastening plate including a first portion and a second portion, the first portion of the fastening plate having a basal end portion, the second portion of the fastening plate being integral with the first portion of the fastening plate and having a distal end portion; and a joint portion that connects the basal end portion of the first portion of the base plate and the basal end portion of the first portion of the fastening plate so that the fastening plate pivots with regard to the base plate, the joint portion being elongated and parallel to the basal end portions;

wherein the base plate and the fastening plate are foldable to face each other in a manner such that the first portions of the respective plates are superposed on each other, and that the second portions of the respective plates are superposed on each other, wherein the second portion of the fastening plate is formed with a slit extending from the distal end portion of the fastening plate toward the basal end portion of the fastening plate, wherein the slit of the fastening plate, over its entire length, extends through the fastening plate in a thickness direction of the fastening plate and splits the distal end portion of the second portion of the fastening plate.

2. The handicraft clip according to claim 1, wherein the slit formed in the fastening plate is located at a widthwise center of the second portion of the base plate when base plate and the fastening plate are superposed on each other.

3. The handicraft clip according to claim 1, wherein the second portion of the base plate is formed with a slit extending from the distal end portion of the base plate toward the basal end portion of the base plate.

4. The handicraft clip according to claim 3, wherein the slit formed in the base plate is located at a widthwise center of the second portion of the base plate.

5. The handicraft clip according to claim 1, further comprising a lock for keeping the base plate and the fastening plate superposed on each other.

6. The handicraft clip according to claim 5, wherein the lock includes a through-hole and a protrusion to be fitted into the through-hole, the through-hole being formed in one of the first portions of the respective plates, the protrusion being formed on the other of the first portions of the respective plates.

7. The handicraft clip according to claim 6, wherein the protrusion is fitted in the through-hole in a manner such that an end portion of the protrusion sticks out beyond an end portion of the through-hole.

8. The handicraft clip according to claim 1, wherein the second portions of the respective plates have cloth holding surfaces brought into facing relation when the second portions are superposed on each other, each of the cloth holding surfaces being formed with an elongated projection extending widthwise of the second portions.

9. The handicraft clip according to claim 3, wherein the slit of the base plate extends through the base plate in a thickness direction of the base plate and splits the distal end portion of the second portion of the base plate.

* * * * *